US006478108B1

(12) United States Patent
Linhard et al.

(10) Patent No.: US 6,478,108 B1
(45) Date of Patent: Nov. 12, 2002

(54) SPEAKER BOX

(75) Inventors: Klaus Linhard, Schelklingen; Gerhard Schaller, Augsburg, both of (DE)

(73) Assignee: DaimlerChrysler AG (DE)

( * ) Notice: Subject to any disclaimer, the term of this patent is extended or adjusted under 35 U.S.C. 154(b) by 0 days.

(21) Appl. No.: 09/638,498

(22) Filed: Aug. 15, 2000

(30) Foreign Application Priority Data

Aug. 16, 1999 (DE) ..... 199 38 172

(51) Int. Cl.[7] ..... E04G 1/18
(52) U.S. Cl. ..... 181/141; 181/142
(58) Field of Search ..... 181/141, 142, 181/143, 148, 150, 153, 156

(56) References Cited

U.S. PATENT DOCUMENTS 3,952,159 A * 4/1976 Schott ..... 179/1 E
4,231,445 A * 11/1980 Johnson ..... 181/148
4,549,631 A * 10/1985 Bose ..... 181/155
4,758,047 A * 7/1988 Hennington ..... 297/397
4,953,655 A * 9/1990 Furukawa ..... 181/160
5,173,575 A * 12/1992 Furukawa ..... 181/160
5,189,706 A * 2/1993 Saeki ..... 381/159

FOREIGN PATENT DOCUMENTS

| | | | |
|---|---|---|---|
| DE | 195 07 296 A1 | 9/1995 | H04R/1/28 |
| EP | 0 481 163 A2 | 6/1991 | H04R/1/02 |
| EP | 0 523 410 A2 | 6/1992 | H04R/1/02 |

* cited by examiner

*Primary Examiner*—Marlon T. Fletcher
*Assistant Examiner*—Kim Lockett
(74) *Attorney, Agent, or Firm*—Pendorf & Cutliff

(57) ABSTRACT

For a selective sound propagation pattern that has an especially high directivity, including in the bass frequency region, there is inventively provided a loudspeaker box (1) with a housing (2) and at least one loudspeaker (4) with chassis (6) which is surrounded by a housing wall (8) in such a way that in the low frequency region the rear side and front side sound of the loudspeaker (4) overlay themselves with a sound increase in a preferred direction.

12 Claims, 6 Drawing Sheets

SPEAKER BOX

BACKGROUND OF THE INVENTION

Field of the Invention

The invention concerns a loudspeaker box having a housing and at least one loudspeaker with a chassis.

Loudspeakers are normally built with their chassis in a housing (i.e. a so-called enclosed loudspeaker), in order to avoid, to the greatest possible extent, an acoustical short circuit, i.e. an interaction between the sound generated by the rear side and front side of the speaker and the associated cancellation of those sounds. The sound cancellation results from the motion of the loudspeaker's membrane and the resulting combination of the two out of phase sound waves generated by the membrane's motion. The resulting sound propagation pattern of closed loudspeakers is uniform in nearly all directions, especially for low frequencies. For higher frequencies a directionality will be produced, because of the increase in reflections and propagation time effects caused by the decrease in wavelength, whereby the sound propagation will be concentrated in a particular direction.

The sound cancellation pattern of an open loudspeaker (i.e. a loudspeaker without a housing) is limited, in contrast, by frequency dependency whereby a good sound cancellation pattern is achieved to the greatest possible extent for low frequencies and for high frequencies a substantially poorer sound cancellation pattern is achieved. Additionally, in the region of the surface of the loudspeaker's membrane, a good sound cancellation (i.e. null points) pattern arises over a particularly large frequency band. As a result, the open loudspeaker usually demonstrates a so-called dipole-curve sound pattern in the region of the loudspeaker (also called an "eight-characteristic" curve).

A disadvantage of both loudspeakers—open and closed—is that a sound playback with adequately good directivity in the bass region is not assured. For high frequencies, the closed loudspeaker (the loudspeaker box) is especially suitable, since it achieves an especially good directivity. In the bass frequency region, neither the loudspeaker box nor the open loudspeaker exhibit an adequately good directivity.

Hence, to produce a good directivity in the bass frequency region, usually multiple loudspeakers, e.g. two loudspeakers, will be coupled together. In that case, both of the loudspeakers work in opposing phase from one another. The coupling of both loudspeakers is performed in such a way that the resulting acoustical and electrical paths are adjusted to one another so that the electrical propagation time approximately matches the acoustical propagation time. Different directivity characteristics, e.g. kidney shaped or clubbed shaped directivity characteristics, are realized depending upon the type of loudspeaker that is utilized—a closed or open loudspeaker. Alternatives that can also be used to attain directivity in the bass region are called loudspeaker arrays or loudspeaker lines. These solutions all require additional loudspeakers and therefore their construction is especially equipment intensive and expensive.

SUMMARY OF THE INVENTION

The invention is based upon the task of providing a loudspeaker box that achieves a directionality, including in the bass region, in a particularly simple way. In addition, a headrest shall be provided that realizes a good bass playback response.

The first stated problem is inventively solved by a loudspeaker box that has a housing and at least one loudspeaker with a chassis, that is surrounded in such a way by a housing wall so that in the low frequency region the sound on the rear side and on the front side of the loudspeakers superimpose themselves with an amplification in sound in a given direction.

The invention starts with the concept, that for the individualized broadcasting of sound into predetermined spatial areas, taking into consideration sound propagation, a directionality is to be achieved over a large frequency range, wherein loudspeaker feedback should be avoided. The loudspeaker construction should also be compact, so that it is also useful for small loudspeaker boxes. In place of the traditional loudspeaker arrangement comprising several loudspeakers to achieve a response in the bass region, the invention starts with a single loudspeaker that has an associated chassis and arranges those elements on the housing wall in such a way that a sound amplification arises in a given direction through the superposition of portions of the produced sound. Thereby the housing wall operates as a flat sound-wall for the loudspeaker, so that the combined effect of the rest of the housing front-side and rear-side sounds, which are of different power and phase, leads to a directivity with a sound amplification in a preferred direction and with a sound reduction in the opposite direction. In other words: a directivity in the low frequency region will also be beneficially achieved for the single loudspeaker through the arrangement of the single loudspeaker in the specially adapted housing. Consequently, the directivity of the delivered output in the low frequency region will particularly advantageously be increased.

The sound from the rear side and the front side effectively superimpose themselves in the shape of a pear in the area of the loudspeaker. Such a pear-shape directivity (also called a hyper kidney) is preferably employed in the near field of the loudspeakers and in the bass frequency region. Equally good is, for example, a kidney-form directivity characteristic. Through the appropriate design of the housing wall a directivity can be adjusted such that therefrom a particularly high directivity in the near field of the loudspeaker results for a specified distance.

Preferably the chassis is arranged as a symmetrical, mirror image of the housing. This symmetrical arrangement of the chassis in the cross-section or longitudinal section of the housing results in both sides—front and a rear sides—each having an approximately equal volume of air. Therefore the air resistance or stiffness exerted upon the movement of the speaker's membrane is approximately equal in both directions of movement. Moreover the approximately equal volumes of air on both sides cause an especially equalized base frequency response.

The housing is suitably constructed in the form of a cylinder. Such a tube shaped housing with a circular cross-section makes particularly possible a simple symmetrical arrangement of the chassis. Additionally, a housing in the form of a rectangular box is also preferably suitable for the construction of the loudspeaker box. The cross section of the rectangular box is, for example, a rectangle or a square. Furthermore, a housing may be built with an elongated cross section or longitudinal section, preferably an oval chassis.

A sound opening is preferably provided in the housing for at least both the front side and rear side sound. An equal number of sound openings on both sides is preferred. Furthermore the shape of the sound openings is appropriately selected for particularly good directivity. Advisably at least one of the sound openings is located in the area of the sound cone of the rear side and front side sounds.

In order to obtain sound directing acoustic dampening, at least one of the sound openings is provided with dampening material. For example, the sound opening on the rear of the chassis is provided with dampening material. A selective sound reduction will be produced on one side through this covering of the rear side sound opening. For example, one side of the frequency response will be lowered in broadband, for example, attenuated 1 to 8 dB. A pear shaped sound propagation pattern is obtained through this single sided selective sound dampening. Fibrous material is an example of material that may serve as a dampening material. The sound reduction can be adjustable or variable by installing different acoustical dampening material or variable quantities or thickness of the dampening material, so that an especially good directivity is achieved at a given distance from the loudspeaker box.

This is suitable for the use in a vehicle, in particular in a headrest, in part through the especially compact design and the especially compact construction of the loudspeaker box. Depending on the type and extent of the sound-filled area—the area of the seat associated with the headrest, for example—and also depending upon the desired intensity of the sound of this area, at least one loudspeaker box is integrated into the headrest. Beyond that additional loudspeaker boxes can be provided, particularly in the seat or seat back. The stability of the loudspeaker box also contributes to the mechanical stability of the headrest, particularly when it is part of the frame of the headrest. The mechanical stability of the headrest is provided by an appropriate frame construction and the housing of the loudspeaker box is also so constructed, for instance, out of a soft synthetic material. The opposite case is a loudspeaker box housing that is preferably built out of hard synthetic material or aluminum, where the housing itself contributes to the stability of the headrest. This hard housing section will be appropriately padded, for example, with foam.

The advantage obtained through the invention particularly lies in a housing comprising a housing wall surrounding the loudspeaker chassis and wherein the structure of the sounds from the front side and the rear side of the loudspeaker affect each other, especially at low frequencies, and wherein the sound of one side is specifically so lowered, so that the two sound parts, which each have different power and phase, lead to a superposition with a directivity that has a sound increase or amplification in a preferred direction and a sound reduction or attenuation in the opposite direction.

BRIEF DESCRIPTION OF THE DRAWINGS

Embodiments of the invention will be further explained by the use of figures. The figures illustrate.

DETAILED DESCRIPTION OF THE INVENTION

Similar parts are labeled with the same reference number in all figures.

Figure 1:
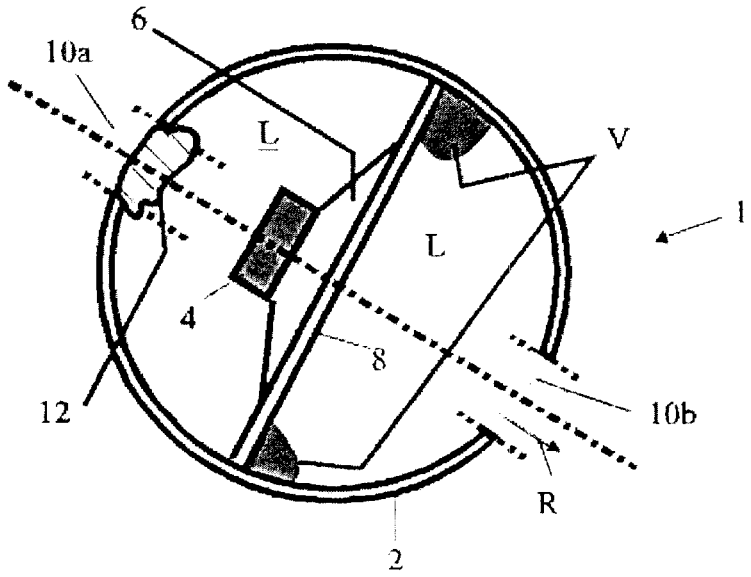
FIG. 1 Cross-sectional schematic of a loudspeaker box.

FIG. 1 illustrates a loudspeaker 1 with a housing 2 and a loudspeaker 4 with a chassis 6. The chassis 6 is surrounded by a housing wall 8.

The housing 2 is formed as a hollow cylinder. The chassis 6 with the housing wall 8 is preferably arranged symmetrically as a mirror image in the housing 2, i.e. the chassis 6 is in a substantially symmetrical arrangement with respect to the housing's 2 lengthwise direction. Because of this, both sides of the loudspeaker 4, to the greatest possible extent, face an equal volume of air L. As an alternative to the symmetrical arrangement of the chassis 6, an arrangement that is partially offset within the housing 6 is also possible. In this arrangement, an essentially equal volume of air L is achieved on both sides of the chassis 6 by arranging a compensation volume V on the side of the larger air volume L, e.g. plastic sealing cord or other plastic elements. By having an approximately equal volume of air on both sides—front side and back side—an approximately equal frequency response is made possible.

The housing wall 8 is built as a flat sound wall. Both the front side and the rear side of the housing 2 have at least one sound opening 10*a* and 10*b*, respectively. In this arrangement, the sound openings 10*a* and 10*b* are arranged on a line that lies on opposite sides of the housing 2 and are each in the area of the sound cones of the rear side and front side sounds, respectively. The sound opening that lies at the rear side of loudspeaker 4 is supplied with dampening material 12. The attenuation material 12 serves to selectively reduce the sound emerging in the direction of the associated sound opening 10*a*, so that in the forward direction of sound opening 10*b*, a sound amplification selectively occurs and an especially high directivity is achieved though an elevated discharge power in the preferred direction that is illustrated with arrow R.

The form, amount and thickness of the dampening material 12 that is arranged in the sound opening 10*a* is selected so that a defined sound lowering and resulting directivity is adjusted into the preferred direction. Preferably a fibrous material will be used as the dampening material. The dampening material 12 achieves an attenuation of about 1 to 8 dB over a particularly wide band frequency range.

Figure 2:
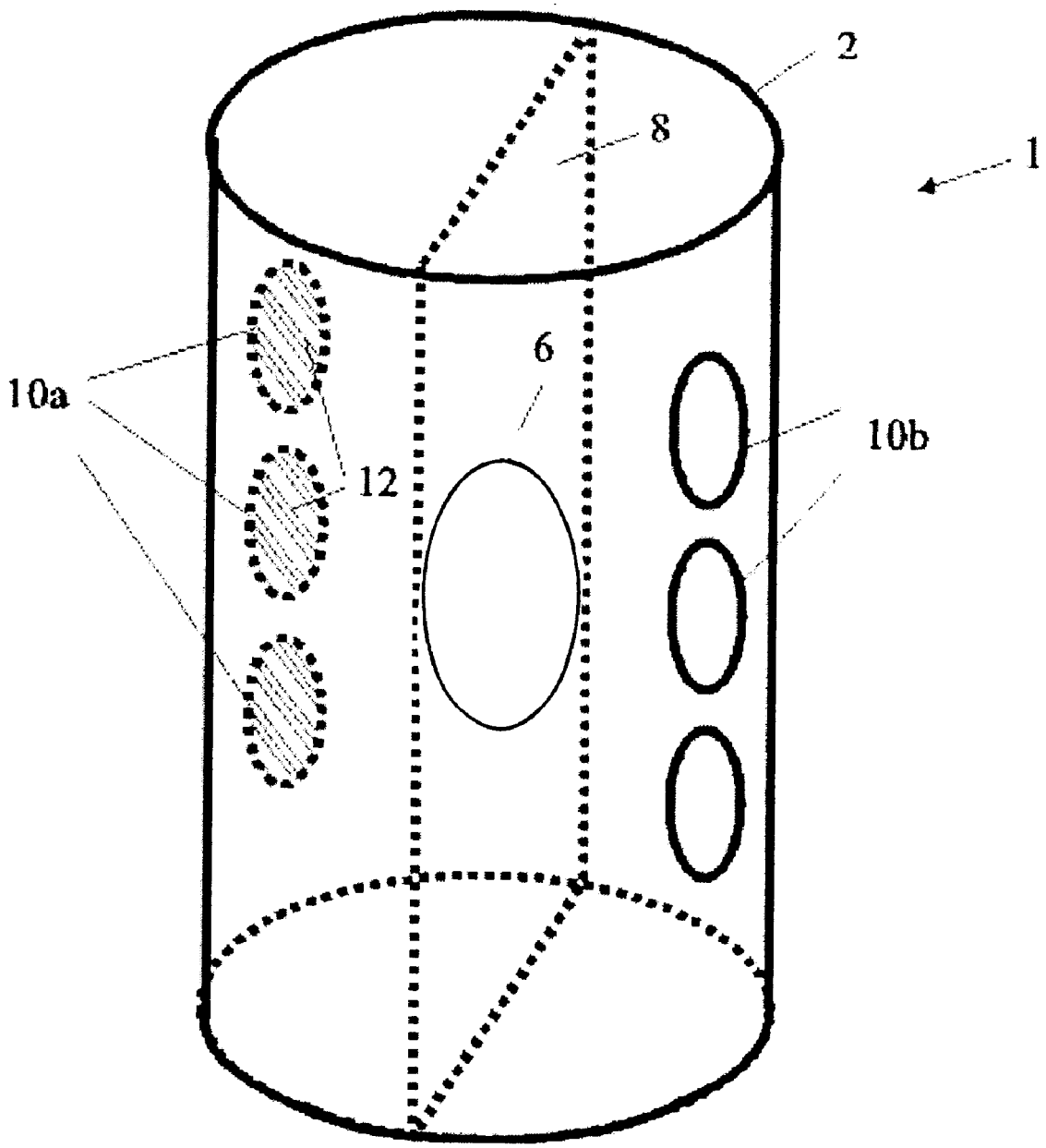
FIG. 2 Schematic of the loudspeaker box according to FIG. 1 in profile.

FIG. 2 shows a side view of the loudspeaker box 1 of FIG. 1, whereby the housing wall 8 that surrounds the chassis 6 extends over the entire length of the housing 2. The housing wall 8 will be introduced in the housing 2, for example and not in the manner illustrated, with the respective ends of the housing 2 closed and attached respectively thereto. A plurality of sound openings 10*a* and 10*b* in housing 2 are intended for both the rear side and also the front side, respectively, of the housing wall 8. The rear side openings 10*a* are provided with dampening material 12. The symmetrical construction of the chassis 6 in the housing 2 can not be only in the longitudinal, but can also be, alternatively, in the cross direction.

Figure 3:
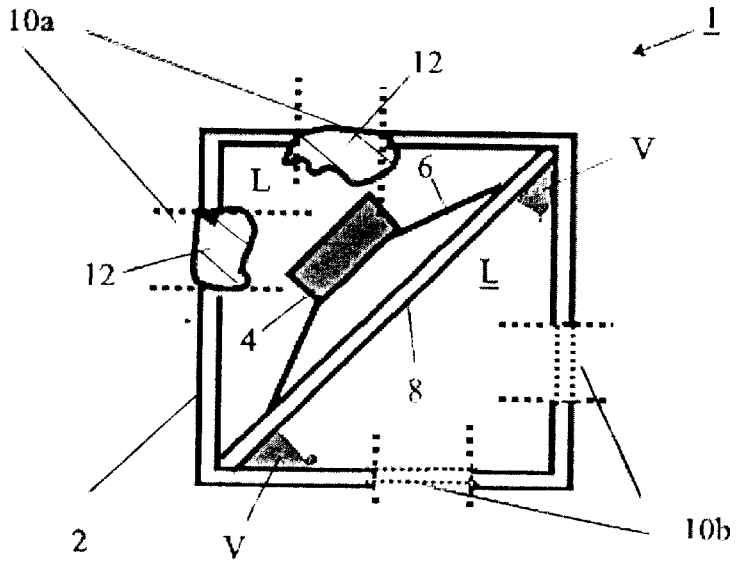
FIG. 3 Schematic of a loudspeaker box implemented as a square box.

FIG. 3 illustrates an alternative form of the loudspeaker box 1, wherein the housing 2 is in the form of a square box. The chassis 6 with the surrounding housing wall 8 and the loudspeaker 4 is arranged symmetrically with regards to the surface that is diagonally placed across the square cross section of the housing 2. The housing 2 is provided with rear and front side sound openings 10*a* and 10*b*, respectively. The rear side oriented sound openings are provided with dampening material 12. Because the arrangement of the loudspeaker 4 reduces the rear side air volume L, the front side of housing 2 has a compensation volume V.

Figure 4A:
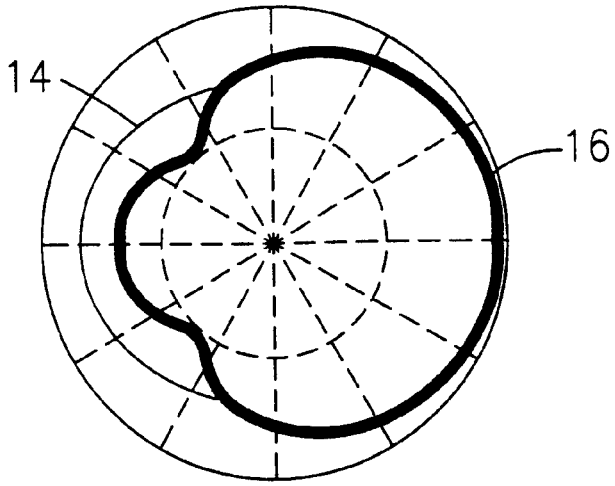
FIG. 4. Diagram of the directivity of the loudspeakers in the near field (FIG. 4*a*) and in far field (FIG. 4*b*).
Figure 4B:
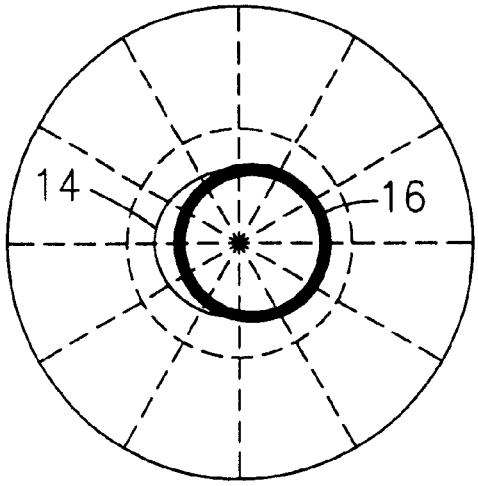

In the operation of the loudspeaker box 1 of FIGS. 1 through 3, the rear side sound of the loudspeaker 4 is specifically lowered by the dampening material 12 that is mounted in the sound opening 10*a*, whereby the two different power and phase sound parts in the forward direction cause a sound increase in the direction of the sound opening 10*b*. Thereby the loudspeaker box 1 causes a sound propagation pattern in the form of a pear, an example of which is shown in FIG. 4*a* for the near field (for approximately 15 cm distance from loudspeaker 4) and is shown in FIG. 4*b* for the far field (for approximately 60 cm distance from loudspeaker 4). The thin line in FIG. 4*a* and FIG. 4*b* respectively characterize the shape of the sound propagation pattern for a high frequency of approximately 600 Hz. The thick line 16 respectively describes the shape of the sound propagation pattern for a low frequency of approximately 150 Hz. The distance of the sound opening 10*a* and 10*b* of the both sides is about 5 cm according to the utilized measuring object. The rear side attenuation for a frequency of approximately 150 Hz is approximately 10 to 25 dB.

Figure 5:
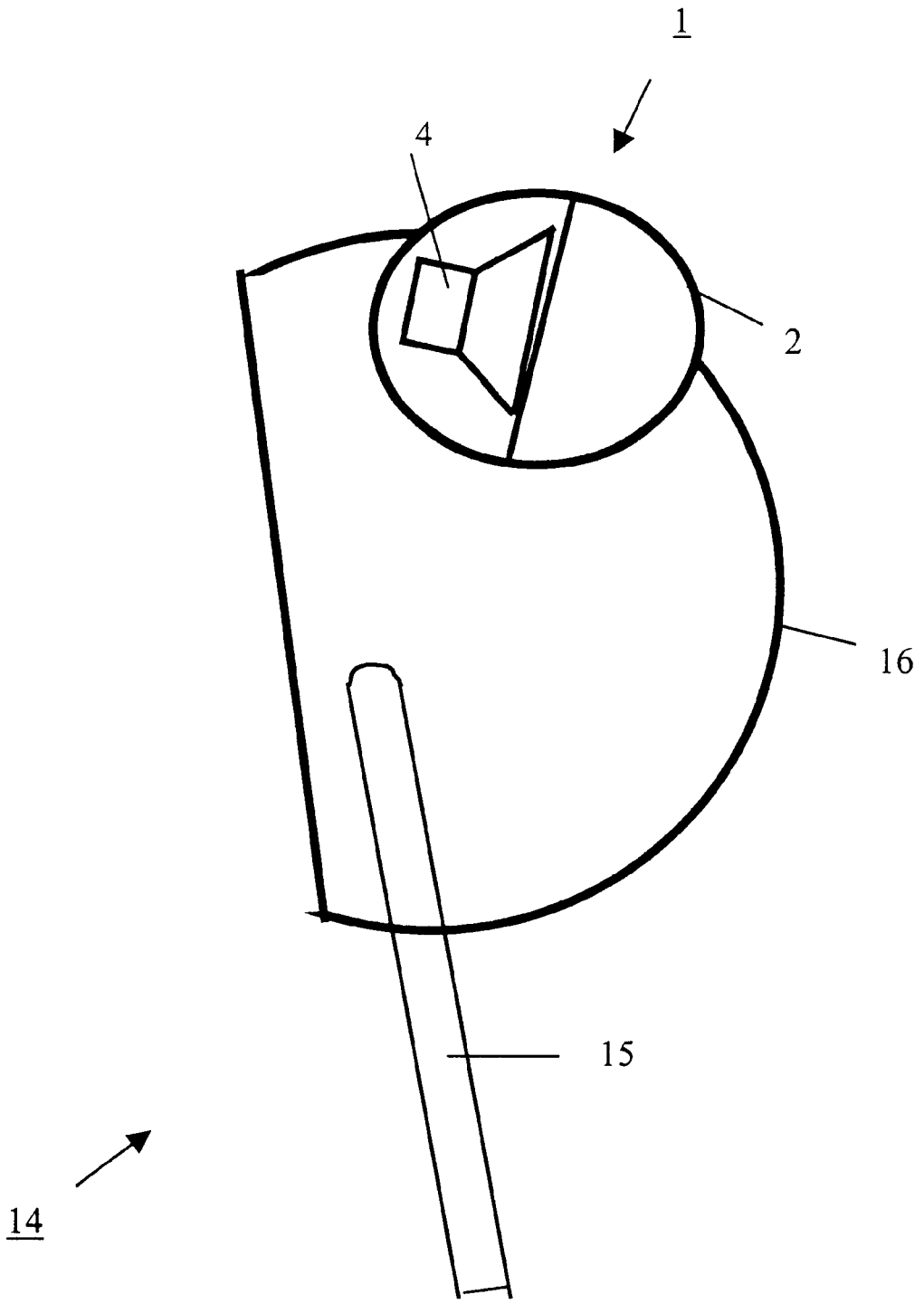
FIG. 5. Profile schematic of a headrest with an integrated loudspeaker

As FIGS. 4*a* and 4*b* illustrate, a so called hyper-kidney is shown, especially in the near field of the loudspeaker 4 of the respective loudspeaker box 1. Accordingly, an especially high directivity to one side is ensured for both high and low frequency, whereby use of the loudspeaker box 1 in a vehicle (not shown), especially in a headrest 14 as is shown in FIG. 5, makes possible an especially well aimed and sufficiently good sound coverage for the seating position associated with the headrest 14. The headrest 14 is installed by means of at least one post 15 onto a seat (not shown), especially onto its backrest.

Preferably, the loudspeaker box 1 will be integrated into the padding of the vehicle's headrest 14.

Figure 6:
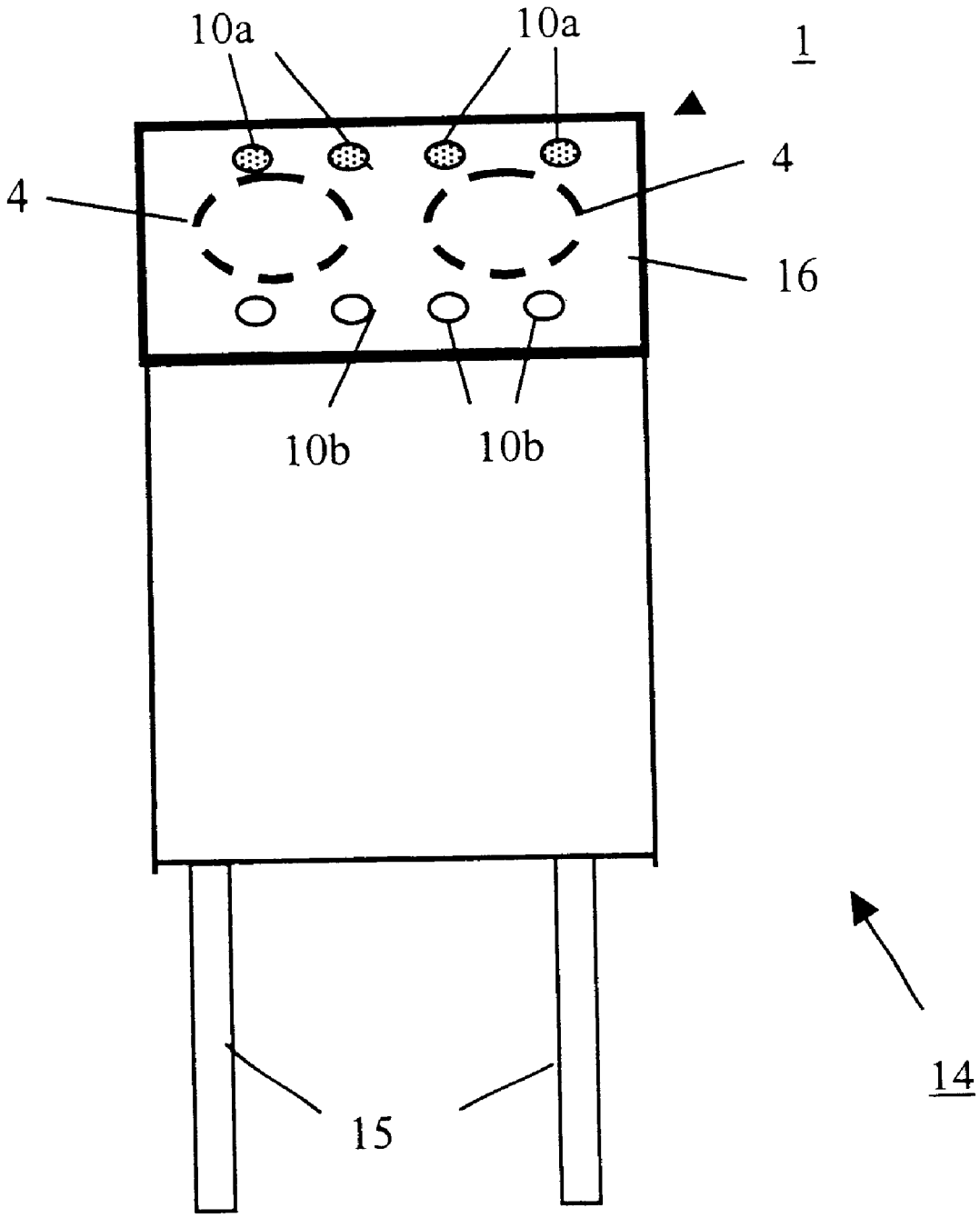
FIG. 6. Schematic of the front view of a headrest with an integrated loudspeaker box.

In FIG. 6 a headrest 14 with an integrated loudspeaker box 1 is illustrated, which includes two loudspeakers 4 that are located close to each other. The loudspeaker 4 arranged inside the loudspeaker box 1 is shown in shadow in this drawing. The headrest 14 is shown in lengthwise section, so that several rear and front side sound openings 10*a* and 10*b*, respectively, are visible. The loudspeaker box 1 is in the upper part of the headrest 14 and is at least partially surrounded by a foam cushion 16.

Figure 7:
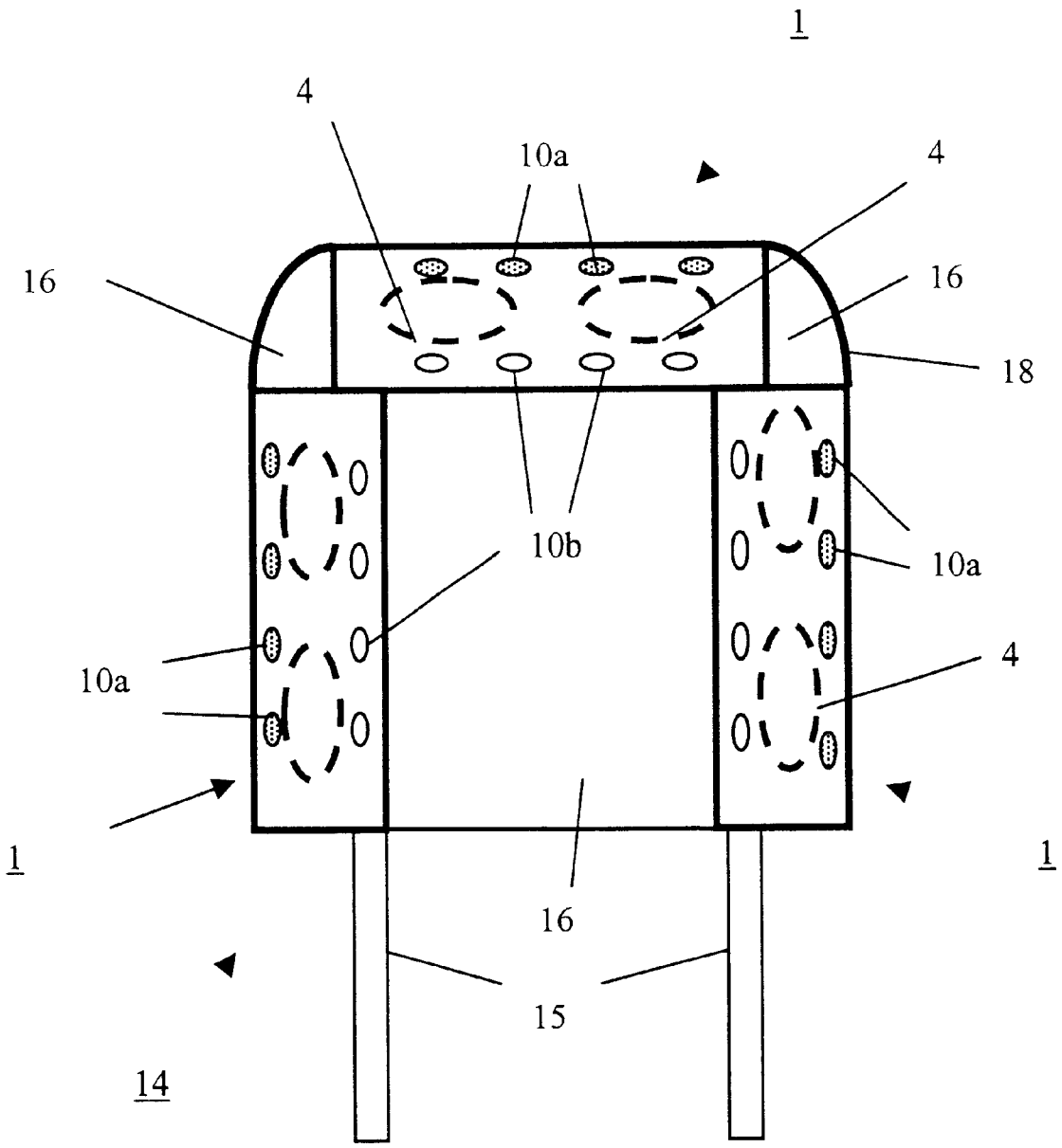
FIG. 7. Schematic of a headrest with an integrated loudspeaker box as a tubular frame.

Through the especially compact design of the loudspeaker box 1 and also through the type of materials used in the housing 2, for example plastic, the loudspeaker box 1 provides a particular mechanical stability of the head rest 14 if it is integral into a solid part of the headrest 14 or if it, as is shown in FIG. 7, is an integral part of the frame 18. Therein the loudspeaker box 1 is surrounded by a tube frame and contains at least one loudspeaker 4 on the inside. Alternatives can also integrate several loudspeaker boxes 1 of different types or a loudspeaker box 1 with a plurality of loudspeakers into the frame 18 of the headrest 14. For example, 2 loudspeaker boxes 1 can be integrated into the headrest 14 such that a stereo playback is possible. A further alternative design for the loudspeaker box 1 is constructed such that the loudspeaker 4 with chassis 6 is incorporated into the hollow area of the frame 18 of the head rest 14, that provides the supporting and protective function of the headrest 14, so that the frame 18 is itself built out of the housing 2 for the loudspeaker box 1. The frame 18 therefore fulfills a double function—housing 2 of the loudspeaker box 1 and also providing for mechanical stability of the headrest 14.

What is claimed is:

1. A loudspeaker box (1) with:

a housing (2), a housing wall connected to said housing, and at least one loudspeaker (4) with a chassis (6) provided within said housing, wherein said loudspeaker is surrounded by said housing wall (8) such that, in a desired direction, the sound emanating from the front and from the rear of the loudspeaker (4) in the low frequency region superimposes itself in a desired direction with a sound amplification, and wherein the chassis (6) is arranged in a symmetrical, mirror image in the housing (2).

2. The loudspeaker box (1) according to claim 1, wherein the housing wall (8) is arranged in the interior of the housing such that on the front side of the housing wall (8) a sound level amplification occurs, and on the rearward side a sound attenuation occurs in the opposite direction.

3. A loudspeaker box (1) with:

a housing (2), a housing wall connected to said housing, and at least one loudspeaker (4) with a chassis (6) provided within said housing, wherein said loudspeaker is surrounded by said housing wall (8) such that, in a desired direction, the sound emanating from the front and from the rear of the loudspeaker (4) in the low frequency region superimposes itself with a sound amplification, and wherein the sound wave superimposition patterns in the area of the loudspeaker (4) on both the rear side and the front side are in the shape of a pear.

4. The loudspeaker box (1) according to claim 1, wherein the housing (2) is in the form of a cylinder.

5. The loudspeaker box (1) according to claim 1, wherein the housing is in the form of a rectangular box.

6. Loudspeaker box (1) according to claim 1, wherein there is respectively provided at least one sound opening (10*a*, 10*b*) for the front-side sound and the rear-side sound.

7. Loudspeaker box (1) according to claim 6, wherein the at least one sound opening (10*a*) is provided with dampening material.

8. Loudspeaker box (1) according to claim 6, wherein said at least one sound opening, (10*a*, 10*b*) is arranged in the area of the sound cones of the rear-side and front-side sound.

9. A method for broadcasting sound into a predetermined spatial area, said broadcast sound characterized by good sound directionality over a large frequency range, including low frequencies, the method comprising:

providing a loudspeaker box (1) with a housing (2), a housing wall connected to said housing, and at least one loudspeaker (4) with a chassis (6) provided within said housing, wherein said loudspeaker is surrounded by said housing wall (8) in such a manner that, in a desired direction, the sound emanating from the front and from the rear of the loudspeaker (4) in the low frequency region superimposes itself with a sound amplification, and broadcasting sound through said loudspeaker box, wherein the chassis (6) is arranged in a symmetrical, mirror image in the housing (2).

10. A headrest (14) with at least one integrated loudspeaker box (1) according to claim 1.

11. A headrest (14) with a plurality of integrated loudspeaker boxes (1) according to claim 1, wherein the housing (2) of the loudspeaker box (1) serves as a frame to provide mechanical stability for its related headrest (14).

12. A method for broadcasting sound into a predetermined spatial area, said broadcast sound characterized by good sound directionality over a large frequency range, including low frequencies, the method comprising:

providing a loudspeaker box (1) with a housing (2), a housing wall connected to said housing, and at least one loudspeaker (4) with a chassis (6) provided within said housing, wherein said loudspeaker is surrounded by said housing wall (8) in such a manner that, in a desired direction, the sound emanating from the front and from the rear of the loudspeaker (4) in the low frequency region superimposes itself with a sound amplification, and broadcasting sound through said loudspeaker box wherein the sound wave superimposition patterns in the area of the loudspeaker (4) on both the rear side and the front side are in the shape of a pear.

* * * * *